United States Patent [19]

Bennett

[11] 3,938,710

[45] Feb. 17, 1976

[54] SAFETY DEVICE FOR AEROSOL CAN

[75] Inventor: Robert A. Bennett, Easton, Conn.

[73] Assignee: The Procter & Gamble Company, Cincinnati, Ohio

[22] Filed: Jan. 13, 1975

[21] Appl. No.: 540,594

[52] U.S. Cl. ..... 222/153; 222/402.11

[51] Int. Cl.[2] ..... B67B 5/02

[58] Field of Search ..... 222/402.11, 153; 251/90, 251/92; 220/21, 59; 215/9

[56] References Cited

UNITED STATES PATENTS

| | | | |
|---|---|---|---|
| 3,272,390 | 9/1966 | Horwitt | 222/402.11 X |
| 3,310,195 | 3/1967 | Wagner et al. | 220/85 R X |
| 3,722,748 | 3/1973 | Wakeman et al. | 222/402.11 X |
| 3,788,510 | 1/1974 | Collins | 215/341 |
| 3,817,416 | 6/1974 | Costa | 215/9 |
| 3,837,537 | 9/1974 | Baldwin | 222/402.11 X |

*Primary Examiner*—Allen N. Knowles
*Assistant Examiner*—Norman L. Stack, Jr.
*Attorney, Agent, or Firm*—F. Eugene Davis, IV; George W. Allen

[57] ABSTRACT

A safety device for aerosol cans prevents accidental discharge of the can during shipment as well as preventing discharge when used by minor children. The device is snapped around the upper peripheral rim of an aerosol can so as to provide a raised platform for the spray nozzle of the aerosol can, and thereby prevents the spray nozzle from activating the spray stem and valve of the aerosol can.

3 Claims, 4 Drawing Figures

FIG. 1
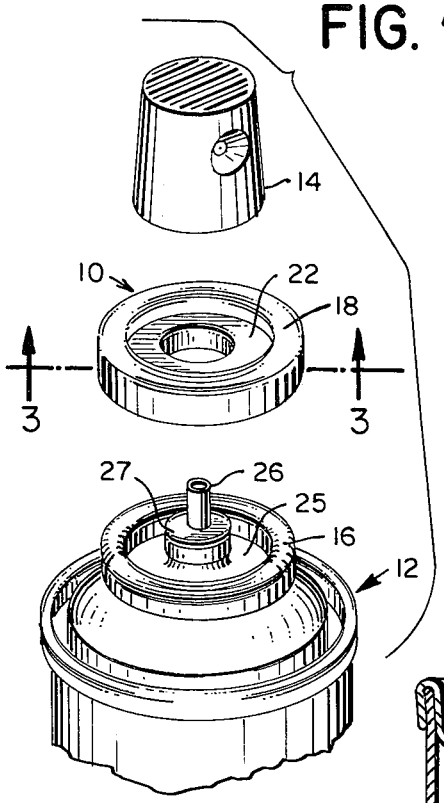
FIG. 2
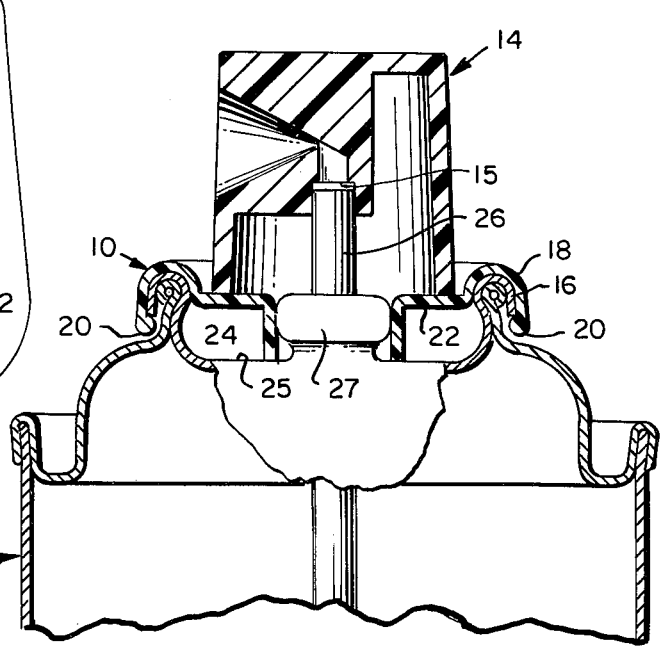
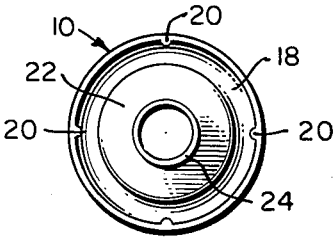
FIG. 3
FIG. 4
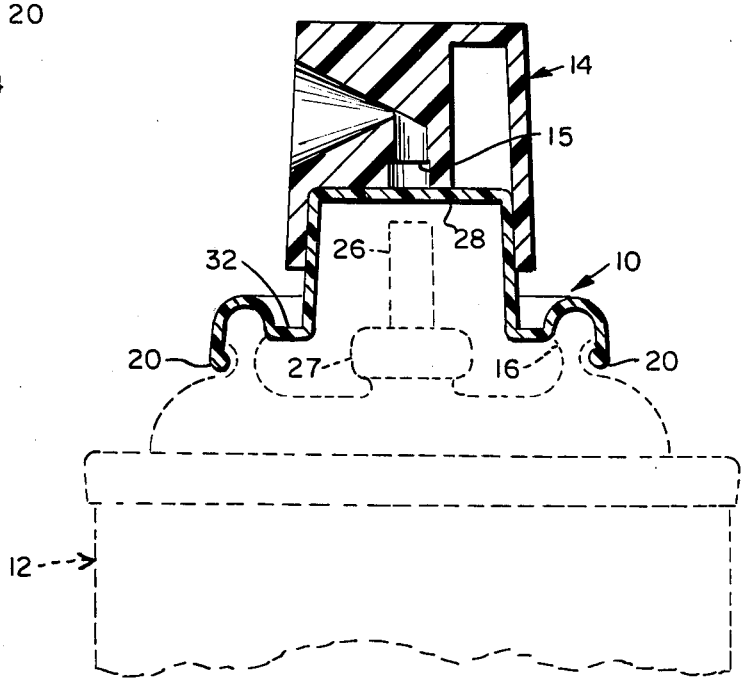

SAFETY DEVICE FOR AEROSOL CAN

BACKGROUND OF THE INVENTION

The present invention pertains to spray prevention devices for use with aerosol cans wherein these spray devices facilitate safe shipping of the aerosol cans.

Recently, the Federal Food and Drug Administration promulgated a rule requiring aerosol cans to be equipped with safety devices that prevent accidental discharge of their contents when such cans are sent through the mails. In addition, it is desirable that the cans be inoperable by minor children, if they try to use the aerosol cans received in the mail.

In view of these objectives, the present invention provides a simple and inexpensive removable aerosol can safety device that snaps over the upper peripheral rim of the spray can and thereby provides a raised portion on which the spray nozzle rests. The raised spray nozzle cannot depress the spray stem and valve of the aerosol can and consequently accidental release of the contents within the aerosol can is avoided. Furthermore, the device is easily removed from the can by an adult so as to allow normal use of the aerosol can.

SUMMARY OF THE INVENTION

The removable safety device for aerosol cans of the present invention incorporates a peripheral overhang member for removably gripping the upper peripheral rim of aerosol cans. In one version of the present invention, the device incorporates an annular table that terminates at its outer portion with the inner edge of the peripheral overhang region and terminates at its innermost region with a downwardly depending cylindrical sidewall. The table provides support for the standard cylindrically shaped nozzle of the aerosol can and thus supports the nozzle's spray activating region above the spray stem and valve of the aerosol can. The downwardly cylindrical sidewall provides structural rigidity to the safety device, especially during inadvertent depression of the spray nozzle.

In a second embodiment of the present invention, the safety device incorporates an upwardly protruding disc-shaped table with cylindrical depending sidewalls that terminate with an inner annular radial projection of the peripheral overhang region. In this embodiment of the present invention, the standard spray nozzle removably interfits on the table and a portion of the downwardly depending sidewall. The spray stem of the aerosol can is completely enclosed by the spray prevention device, and thus the spray nozzle cannot activate the stem.

OBJECTS OF THE INVENTION

It is therefore a principal object of the present invention to provide an aerosol can safety device that prevents the spray nozzle of an aerosol can from actuating the spray stem and valve of the aerosol can.

Another object of the present invention is to provide an aerosol can safety device of the above description that is easily removable from the aerosol can.

A further object of the present invention is to provide an aerosol can safety device of the above description that is inexpensive to manufacture.

Other objects of the invention will in part be obvious and will in part appear hereinafter.

The invention, accordingly, comprises the features of construction, combination of elements, and arrangement of parts which will be exemplified in the construction hereinafter set forth, and the scope of the invention will be indicated in the claims.

THE DRAWINGS

For a fuller understanding of the nature and objects of the invention, reference should be had to the following detailed description taken in conjunction with the accompanying drawings. The same reference numbers refer to the same elements throughout the several view of the drawings.

FIG. 1 is a partial perspective assembly view of an aerosol can incorporating the use of one embodiment of the present invention.

FIG. 2 is a partial side cross-sectional view of the aerosol can and the aerosol safety device of FIG. 1, showing the safety device installed to the aerosol can and the spray nozzle of the aerosol can mounted to the safety device;

FIG. 3 is a bottom plan view taken along lines 3—3 of FIG. 1 of the aerosol can safety device of FIG. 1; and FIG. 4 is a cross-sectional side elevational view of an alternate embodiment of the present invention as it is installed on an aerosol can shown in phantom and as a spray nozzle of the aerosol can is mounted on the safety device.

DETAILED DESCRIPTION

As best seen in FIG. 1, an aerosol can safety device 10 of the present invention is interposed between a standard aerosol can 12 and a standard aerosol can spray nozzle 14, having a spray stem actuating region 15 (FIG. 2). As seen in FIGS. 1 and 2, the safety device mounts about an upper peripheral circular rim 16 of the aerosol can via an annular peripheral inverted U-shaped overhang member 18. As best seen in FIG. 2, this overhang member incorporates a number of inwardly projecting detents 20 at its outer termination that snaps under the termination of the upper circular rim of the aerosol can, and thereby prevents the safety device from dislodging from the aerosol can rim during shipment of the can or during unauthorized use of the can by minor children and the like.

As best seen in FIGS. 1, 2 and 3, the aerosol can safety device further incorporates an annular table 22 protruding inwardly from the overhang region 18 so as to provide a region for the spray nozzle 14 to mount thereon. In addition, the safety device incorporates a cylindrical sidewall 24 downwardly depending from the innermost termination of the annular table 22, so as to make contact with an upper annular table 25 and a central donut-shaped portion 27 of the aerosol can. This sidewall provides structural rigidity to the safety device and prevents downward movement of the spray nozzle with respect to the aerosol can.

As best seen in FIG. 2, when the safety device of the present invention is mounted to the aerosol can, the spray nozzle is unable to move downward with respect to the aerosol can and thus, the spray stem actuating region 15 of the nozzle is unable to depress a spray stem 26 of the aerosol can. This in turn prevents the aerosol valve (not shown) from being opened and consequently, the release of the contents from the aerosol can is prevented.

As best seen in FIG. 4, an alternate embodiment of the present invention prevents the spray nozzle from activating the spray stem of the aerosol can by being physically interposed between the spray nozzle and the aerosol can. In this version of the present invention, the safety device incorporates a central disc-shaped table 28 that terminates with a downwardly depending sidewall 30. This sidewall not only supports the central table but also provides a region for the inner sidewalls of the spray nozzle to rest upon. An annular radially projecting region 32 of the overhang member 18 connects the sidewall to the annular peripheral overhang region 18. This alternate embodiment of the aerosol safety device mounts to the upper circular rim 16 of the aerosol can in the same manner as the first embodiment of the invention.

As is best seen in FIGS. 2 and 4, both versions of the present invention may be easily, manually removed from the aerosol can by placement of the fingernail beneath the annular overhang region 18 and lifting thereof so as to dislodge the inwardly projecting detents from the upper rim of the aerosol can. After removal of the safety device, the spray nozzle of the aerosol can may be placed on the spray stem so as to allow normal operation of the aerosol can.

Preferably, the safety devices of the present invention are molded from plastic, so as to provide extremely inexpensive manufacture thereof as well as allowing easy manual removal of the device from the aerosol can after it has reached its intended destination. Thus, the present invention provides an inexpensive removable aerosol can safety device that prevents the inadvertent discharge of the contents of the aerosol can during shipment thereof as well as preventing their discharge by minor children.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention, what is claimed is:

1. A safety device for aerosol cans having an upper circular rim, a spray nozzle and a spray stem, comprising:

A. an outer annular overhang member removably mountable about the upper circular rim of the aerosol can;

B. an annular table terminating at its outer periphery with the inner termination of said overhang region for placement of the aerosol can spray nozzle thereon; and C. a cylindrical sidewall downwardly depending from the inner termination of the annular table so as to provide structural rigidity to the device as well as preventing downward movement of the spray nozzle with respect to the aerosol can and thereby preventing depression of the spray stem by the spray nozzle.

2. A safety device for aerosol cans as defined in claim 1, wherein the annular overhang region incorporates a plurality of inwardly projecting detents for rigidly embracing the circular rim of the aerosol can.

3. A safety device for an aerosol can having an upper circular rim, a spray nozzle, and a spray stem, comprising:

A. a central disc-shaped table for placement of the spray nozzle above the spray stem of the aerosol can;

B. a cylindrical sidewall downwardly depending from the central table, for providing structural rigidity to the device as well as support for a portion of the spray nozzle; and C. an annular peripheral overhang region terminating at its innermost projection with the cylindrical sidewall and removably embracing the upper circular rim of the aerosol can;

whereby the safety device is interposed between the spray stem of the aerosol can and the spray nozzle and thereby prevents discharge of the contents of the aerosol can.

* * * * *